United States Patent [19]

Matthies

[11] 4,166,996

[45] Sep. 4, 1979

[54] THERMOSTATIC CONTROL DEVICE

[75] Inventor: Alan A. Matthies, Milwaukee, Wis.

[73] Assignee: The Singer Company, New York, N.Y.

[21] Appl. No.: 865,540

[22] Filed: Dec. 29, 1977

[51] Int. Cl.[2] ..... H01H 37/46; H01H 37/74

[52] U.S. Cl. ..... 337/386; 200/83 P; 337/136

[58] Field of Search ..... 337/298, 307, 321, 386, 337/387, 388, 389, 390, 391, 320, 117, 118, 119, 131, 132, 133, 135, 136, 317, 318; 60/527, 528, 529; 200/67 DB, 83 P, 340, 159 R, 159 A, 83 NM, 83 SA; 335/188

[56] References Cited

U.S. PATENT DOCUMENTS

| | | | |
|---|---|---|---|
| 2,738,397 | 3/1956 | Slonneger | 200/83 P |
| 3,202,789 | 8/1965 | Morris | 337/386 |
| 3,984,650 | 10/1976 | Budlane et al. | 200/83 SA |

*Primary Examiner*—Harold Broome

[57] ABSTRACT

Movement of the diaphragm pad occasioned by change in pressure within the diaphragm in response to a change in sensed temperature causes the bowed actuating spring to increase or decrease the degree of flexure to actuate the switch. In order to accommodate the pressure variations induced by a wide range of ambient temperature conditions the diaphragm is preloaded by a second bowed spring. A cam mechanism can be provided to vary the flexure of the preloading spring to thereby adjust the temperature at which the switch will be actuated.

11 Claims, 6 Drawing Figures

THERMOSTATIC CONTROL DEVICE

BACKGROUND OF THE INVENTION

Simple automotive air conditioning systems have long been provided with a temperature responsive switch to control operation of the compressor clutch with the advantage that no energy is wasted in driving the compressor when compression is not required. Switches for controlling clutch operation are therefore quite old.

In recent times, automotive air conditioning systems have become rather sophisticated and have involved operation of the compressor at all times with some penalty by way of energy consumption. With the growing emphasis on fuel economy, there is renewed interest in the on/off type operation of the compressor. To satisfy a public accustomed to relatively close control of the temperature in the air conditioned automobile, the operating characteristics demanded for the thermostatic switch have been made more stringent. In addition the switch must be capable of operating in rather hostile environments so far as dust and moisture are concerned and hold a set point after repeated cycling between ambient temperatures of −40° to +135° C. These requirements, therefore, occasion a fresh look at the problem of designing the control.

SUMMARY OF THE INVENTION

A primary object of this invention is to provide a very low friction mechanism for utilizing the motion of a diaphragm. While nothing is frictionless, the present mechanism has very little frictional hysteresis and is, therefore, capable of holding very close operational tolerances. The mechanism simply involves having the diaphragm work axially against a bowed flat spring. Thus, motion of the diaphragm increases or decreases the flexure of the spring. The deflection (greater or less bow of the spring) is utilized to actuate the switch. The mechanism uses no levers or pivots. The amount of relative motion between the end of the flat spring and the diaphragm pad or between the other end of the flat spring and its bearing point is minimal within the range of movement utilized.

By varying the amount of initial bow imparted to the spring, the effective leverage ratio of the mechanism can be adjusted to suit the needs of the occasion. Similarly, the point along the length of the blade utilized in imparting the motion to the switch actuator can have an effect on the effective ratio. The illustrated design provides a ratio of about 1.3 to 1, that is, the actuating point of the switch moves about 1.3 times as far as the diaphragm pad.

The amount of initial bow imparted to the actuating spring can also affect the effective spring rate of the flat spring. If the flat spring is bent past its critical bow, the actuating spring can in effect become rateless. This is a feature offering interesting possibilities.

Another object of the invention is to adapt the basic concept of the bowed actuating spring to a thermal mechanism subjected to a wide range of temperatures which result in a wide range of internal forces actuating the diaphragm which could subject the diaphragm to severe strain or deflect the diaphragm past its elastic limit. To prevent such problems a preloading spring is added to the mechanism to reduce the amount of motion at the diaphragm pad. This second spring renders the basic concept suitable for use in the desired environment and also makes possible provision for adjusting the response point of the thermal switch by varying the deflection of the preloading spring. This changes the preload which in turn changes the response temperature.

Finally, an object is to provide a system capable of using R22 as a charge to obtain a greater pressure change for a given temperature change and to take advantage of the inherent better altitude compensation found with an R22 charge.

IN THE DRAWINGS

DESCRIPTION OF THE PREFERRED EMBODIMENTS

Figure 3:
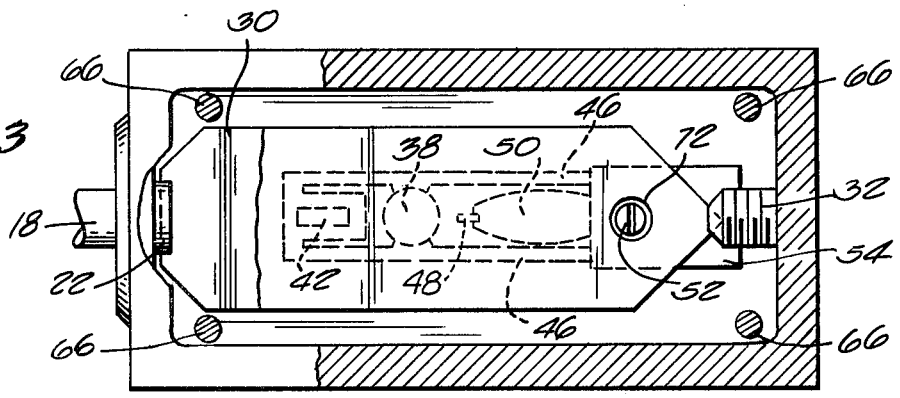
FIG. 3 is a fragmentary partial section through the switch of FIG. 1 or 2 showing the manner of anchoring the blade in the diaphragm pad and adjusting screw and also showing the manner of gaining access to the adjustable switch stop.

The thermostatic control has an extruded body 10 having one end wall 12 machined and apertured to receive the diaphragm assembly 14 which is staked to the wall 12. The diaphragm cup 16 has a sealed capillary 18 to project into the space where the temperature is to be sensed (in this case it would be the evaporator coil). Diaphragm 20 flexes in response to changes in pressure of the thermal charge in response to ambient temperature. Diaphragm pad 22 is provided with two parallel slots 24, 26 which serve as seats for the forked ends of actuator spring 28 and loading spring 30, respectively to prevent the ends of the spring slipping off the diaphragm pad. The opposite end of each of the bowed springs is pointed (FIG. 3) for reception in the conical seat on the inner end of the two adjusting screws 32, 34 threadably mounted in the opposed end wall 36.

As the diaphragm 20 flexes with changes in the sensed temperature, the bow or flexure of actuating spring 28 will change. This motion of the spring is utilized to actuate the switch through the plastic actuating button 38 fixed on switch blade 40. Blade 40 is staked to support 42 and has a movable terminal 44 on its other end. The blade 40 includes side rails 46, 46 which straddle the fixed pivot 48 which serves as a bearing point for the left end of compression tongue 50 formed out of the blade material. When the parts are in the position shown in FIG. 1, the compression tongue 50 exerts an upward force on the movable contact 44 to hold the movable contact against the adjustable stop 52 threadably mounted in the plastic post 54. When the actuating button 38 is moved down until the side rails pass below the point at which the compression tongue bears against the pivot 48, the effective force derived from the tongue 50 reverses and causes the movable terminal 44 to move with the snap action into contact with the terminal 56 carried by the spade terminal 58. This completes the circuit from connecting terminal 60 through blade 44 (and tongue 50), movable terminal 44, fixed terminal 56, to connecting terminal 58. This position is shown in FIG. 2. The spade terminal 60 is one piece with post 48 and the pivot 42 while spade 58 is part of supporting terminal 56. Both are molded into a plastic base 62 which includes the plastic support post 54 carrying the stop 52. The plastic base 62 is molded to fit within the end of the extruded body 10.

Figure 1:
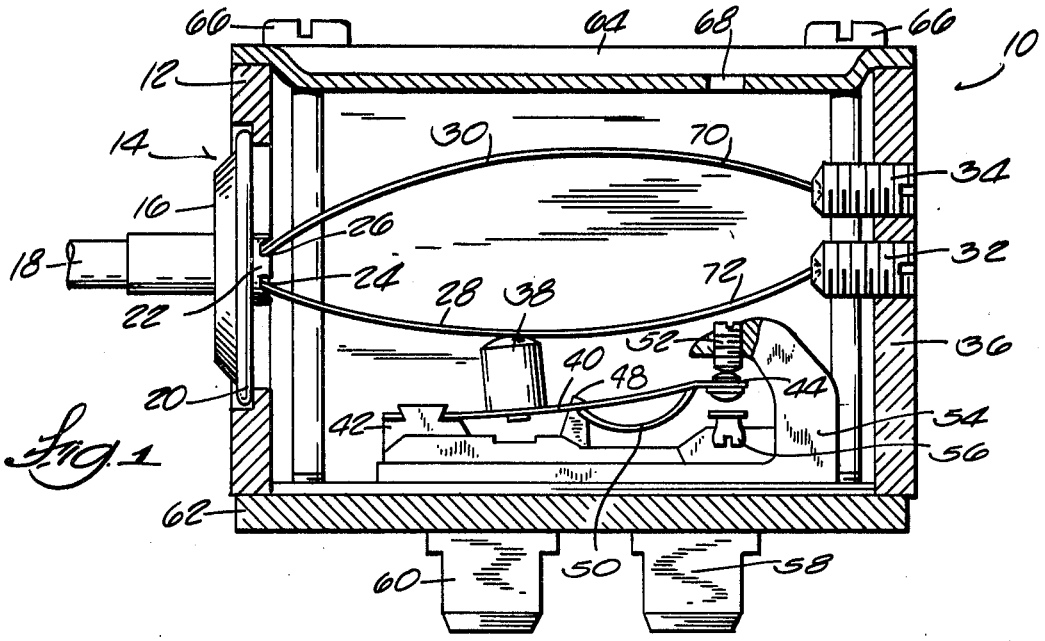
FIG. 1 is a vertical section through a non-adjustable control.
Figure 2:
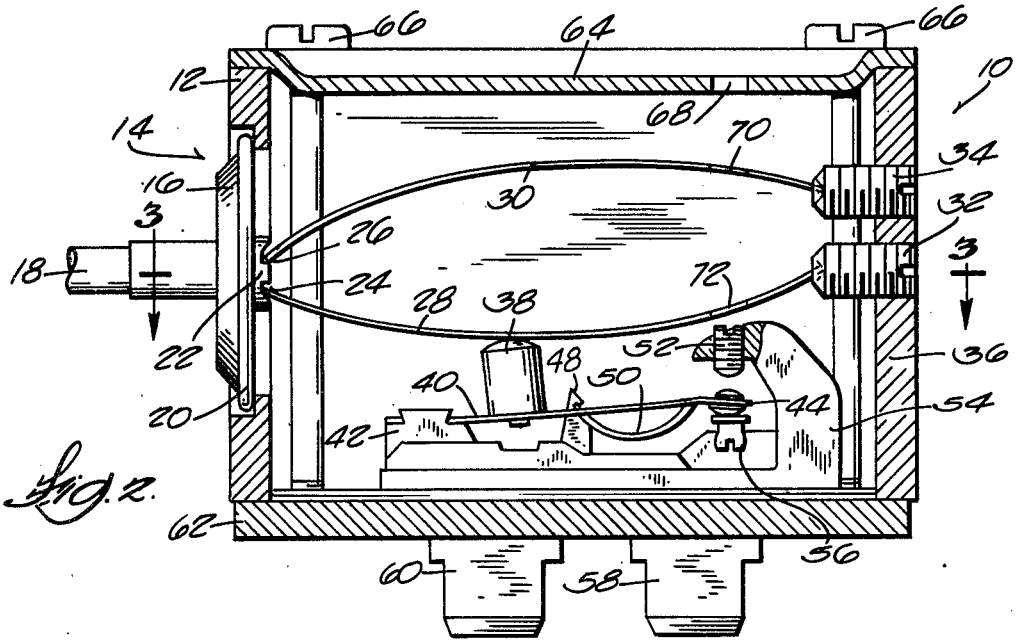
FIG. 2 is a view similar to FIG. 1 but with the switch in the actuated position.

As thus far described, it will be apparent that as pressure increases to flex diaphragm 22 from the position shown in FIG. 1 the actuating spring 28 will be bowed more and will move button 38 downwardly until the switch snaps to the position shown in FIG. 2 completing the circuit from terminal 60 to terminal 58. As the temperature decreases the diaphragm moves to the left and the reverse will occur, opening the circuit. Actuation of the switch by flexure of the actuating spring by the axial movement imparted to the spring is thought to be novel.

The present control is designed to be subjected to a very wide range of ambient temperatures and, therefore, means are provided to preload the diaphragm. This is required in part because the effective spring rate of the bowed spring operating under the conditions shown is very low or can be made flat. Preload is provided by the preload spring 30 bowed to stress the blade and impose a load against the diaphragm pad 22. The assembly is finished off by means of a cover plate 64 closing the end of the housing opposed to the switch. The cover plate 64 and the plastic base 62 are held in assembled position on the extruded body 12 by means of through bolts 66 which serve only to interconnect the two ends with no direct connections between either end and the extruded body. This permits expansion and contraction of the body without distorting the switch base 62 with adverse effect on switch operation or calibration. The cover 64 is apertured at 68 in alignment with apertures 70, 72 in springs 30, 28 to afford access to the adjustable stop 52. After adjusting stop 52, a piece of tape can be applied across the hole 68 to provide a construction which is about as close to hermetic as a construction can get without being hermetic (a hermetic seal is unacceptable in a device of this type). This provides very good environmental protection for the switch.

The switch body 10 is designed to be mounted under the hood of an automobile and can be subjected to some rather high temperatures ranging between 80° and 120° C. The control must operate satisfactorily under those conditions and, therefore, the thermal expansion of the actuating spring and of the extruded body are made substantially identical by fabricating the spring out of beryllium copper and the body out of extruded aluminum. Thus, with the body and spring 28 expanding and contracting at the same rate, the curvature of spring 28 will be unaffected by changes in ambient temperature and, therefore, the switch will be actuated at the desired temperature sensed at the capillary 18. The loading spring 30 force is not critical and is, therefore, fabricated of stainless steel which can generate higher loads than could a corresponding beryllium copper spring. The differential in temperature induced expansion of the loading spring and of the body will not occasion a significant change in load on the diaphragm affecting operation of the control.

In order to properly calibrate the present control, it has been found necessary to finish the calibration with adjustment of the diaphragm position (preload) as opposed to adjusting the actuating point of the switch per se. Thus, the switch is calibrated by immersing the sensing capillary in a constant temperature bath conveniently, for example, 32°. Then the preload adjusting screw 34 is turned in to overload the diaphragm. With this condition obtaining, the actuating spring adjusting screw 32 is turned in to actuate the switch to close the circuit and then back off to just open the circuit. At this point, the preload adjusting screw 34 is backed off to decrease the preload until the switch again makes. Then the adjusting screw is turned in until the switch just trips open. When so adjusted the control can easily maintain operation at a set point plus or minus 1° even after repeated cycling over the wide temperature range mentioned above. Development of this control brought another requirement to light in that it has been found necessary to fabricate the body out of a material which remains dimensionally stable after repeated cycling over a wide temperature range. It was found unsatisfactory to use a die cast zinc body since the body actually grew (as opposed to expanding with heat) after being cycled over the abovementioned wide temperature range. The growth was permanent and since this in effect moves the two anchor points of the actuating spring further apart, it obviously affected operation and calibration of the switch. It has been found eminently satisfactory to fabricate the body out of an extruded shape where the extruded shape is simply cut to the proper length (i.e., height of the body shown). When made of extruded aluminum, the cost considerations are favorable. The aluminum remains dimensionally stable. A cast aluminum body could be used but cost considerations favor the extruded body.

Figure 4:
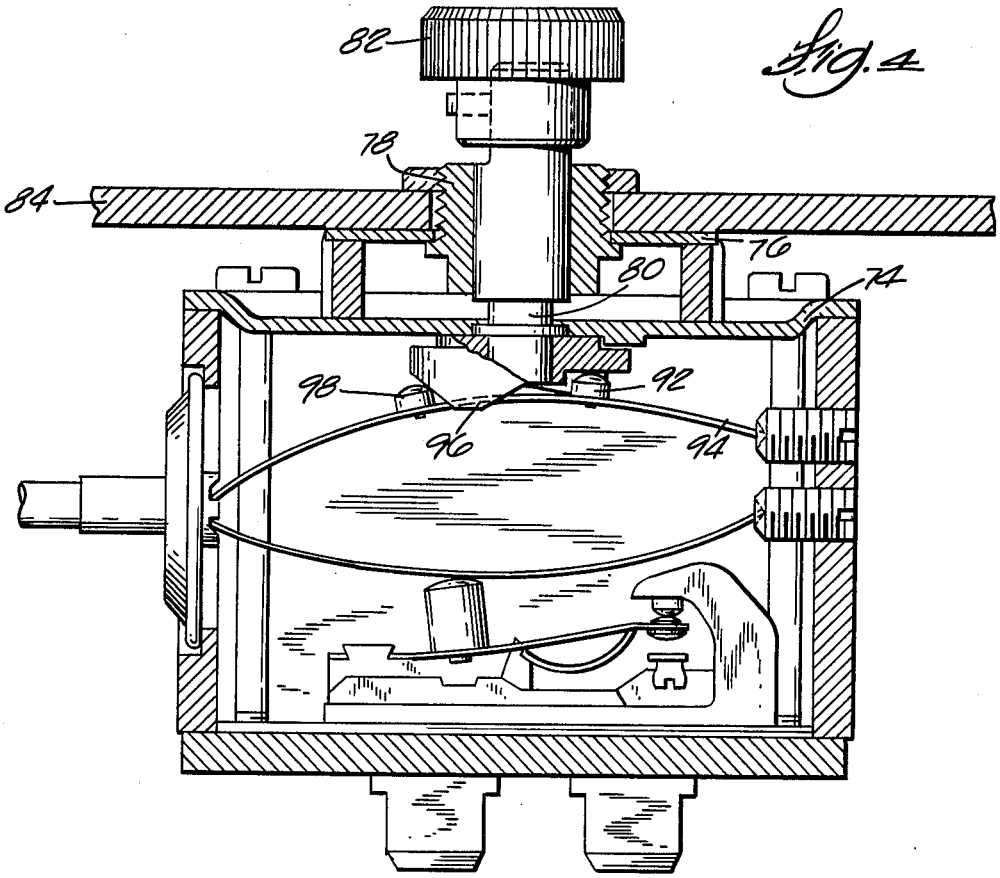
FIG. 4 is a vertical section through an adjustable control mounted in a panel.
Figure 6:
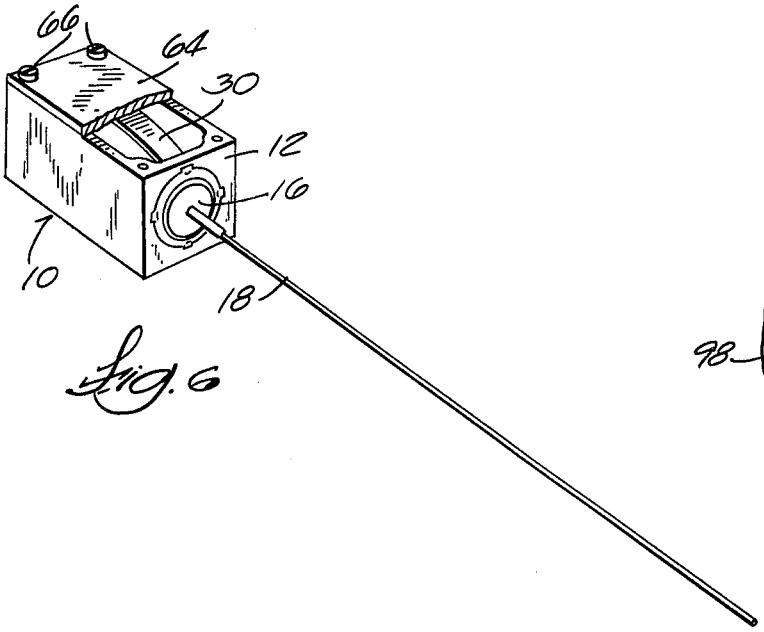
FIG. 6 is a perspective of a complete thermal switch in this case, the nonadjustable switch.
Figure 5:
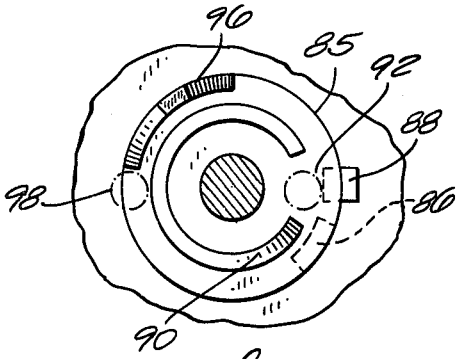
FIG. 5 is a view taken as indicated by line 5 on FIG. 4 showing the adjusting cam track and the "off" cam or lug.

This control is designed to control engagement or disengagement of the compressor clutch in an automotive air conditioning system in accordance with a fixed response temperature. There are instances where the factory set temperature is not completely desirable and, therefore, the driver is afforded the opportunity to adjust the response temperature. The present design is readily adapted to such operation by the construction shown in FIGS. 4 and 5. In this construction, the plain upper cover plate 64 of the first embodiment is replaced by a cover plate 74. The plate 74 is provided with a spacer bracket 76 into which bushing 78 is threaded to journal shaft 80 for actuation by the manual knob 82. The exterior of the bushing 78 is threaded to permit mounting in the dashboard or control panel 84 in the conventional manner. The inner end of rotatable shaft 80 is provided with a disc, the upper surface of which is provided with a stop lug 86 which will abut the fixed stop 88 depending from cover 74 at the two extremes of rotational movement of the disc 85, thus limiting the rotation of the disc to somewhat less than 360°. The underside of the disc 85 is provided with two cam surfaces. The inner cam surface 90 is adapted to bear on button 92 carried on the preload spring 94. The gradual rise of the cam track 90 permits adjustment of the degree to which button 92 is depressed to adjust the preload of the spring 94 and the response temperature of the control. As the greater deflection is imparted by cam 90, the right end portion of spring 94 is more or less flattened. It has been found that if the control is to be provided with an "off" position, the further adjustment of the spring 94 by cam 90 becomes counter-productive, that is, the spring is now given an S-shaped curve. To obviate this problem the disc is provided with a second active cam 96 acting against a second actuating button 98 to push that portion of the blade down when the "off" position is reached. This flattens a greater section of the loading spring and increases the preload to a point where the diaphragm is incapable of actuating the switch.

I claim:

1. A thermostatic control comprising a housing, temperature responsive heat motor means mounted in a wall of the housing and including a movable member, an abutment fixed in a wall of the housing opposed to the wall in which the motor means is mounted, a flat spring member mounted in the housing between the movable member and said abutment and having a length greater than the distance between the movable member and the abutment whereby the spring member is initially bowed and the bow of the spring changes with movement of the movable member, and a control device actuated by the spring member as it flexes, the coefficient of expansion of the spring member and the housing being substantially the same whereby the control is temperature compensated.

2. A control according to claim 1 in which said control device is mounted in said housing so as to be unaffected by expansion and contraction of said housing.

3. A thermostatic control comprising a housing, temperature responsive heat motor means mounted in the housing and including a movable member, a flat spring member mounted in the housing between the movable member and a fixed abutment and having a length greater than the distance between the movable member and the abutment whereby the spring member is initially bowed and the bow of the spring changes with movement of the movable member, and a control device actuated by the spring member as it flexes said heat motor means including a charged diaphragm and feeler assembly and the movable member being a diaphragm pad, and a second spring member mounted between the diaphragm pad and a second fixed abutment and initially flexed to pre-load the diaphragm.

4. A control according to claim 3 in which the control device is a snap switch including an actuating button bearing against the first spring member at a point between the diaphragm pad and the first abutment.

5. A control according to claim 4 including means for adjusting the first abutment generally axially of the spring member to adjust the trip point of the switch, and means for similarly adjusting the second abutment to adjust the pre-load force on and position of the diaphragm pad at a given temperature.

6. A control according to claim 5 in which the housing is made of metal which retains dimensional stability at a given temperature after repeated exposure to a wide range of temperatures and has substantially the same coefficient of expansion as the first spring.

7. A control according to claim 6 in which the housing comprises an extruded open-ended metal housing and the switch is mounted in a plate closing one end of the metal housing and the other end of the housing is closed by a second plate, said plates being directly interconnected with the housing sandwiched between.

8. A control according to claim 5 including cam means acting on the second spring member to flex the second spring member and adjust the response temperature of the control.

9. A control according to claim 8 in which the cam means includes means for flexing the second spring member to a position preventing actuation of the switch.

10. A control according to claim 9 in which the cam means comprises a disc having a circular cam track and mounted on a shaft rotatably mounted in the housing and provided with a knob outside the housing, said disc also being provided with a lug engageable with the spring member and operative to flex the spring member at a point separate from the point of engagement of the cam track with the spring member and positioned relative to the cam track so the cam track imparts maximum flexure to the spring member when the lug engages the spring member.

11. The method of factory calibrating the control of claim 5 comprising the steps of subjecting the feeler to a given constant temperature, adjusting the first abutment to the switch trip point, and then adjusting the second abutment to the switch trip point.

* * * * *